US010052902B1

(12) United States Patent
Joseph

(10) Patent No.: US 10,052,902 B1
(45) Date of Patent: Aug. 21, 2018

(54) BOOKMARK WITH LINE INDICATOR AND PAGE TURNER

(71) Applicant: Berris-Dale Joseph, Anchorage, AK (US)

(72) Inventor: Berris-Dale Joseph, Anchorage, AK (US)

( * ) Notice: Subject to any disclaimer, the term of this patent is extended or adjusted under 35 U.S.C. 154(b) by 208 days.

(21) Appl. No.: 15/153,221

(22) Filed: May 12, 2016

Related U.S. Application Data

(60) Provisional application No. 62/160,073, filed on May 12, 2015.

(51) Int. Cl.
*B42D 9/00* (2006.01)
*B42D 9/04* (2006.01)
*A41D 13/08* (2006.01)

(52) U.S. Cl.
CPC ..... *B42D 9/007* (2013.01); *A41D 13/087* (2013.01); *B42D 9/04* (2013.01)

(58) Field of Classification Search
CPC ..... A41D 13/087; A41D 13/08; B42D 9/00; B42D 9/001; B42D 9/004; B42D 9/005; B42D 9/007; B42D 9/008; B42D 9/04
USPC ..... 116/234–240; 281/42
See application file for complete search history.

(56) References Cited

U.S. PATENT DOCUMENTS 1,272,149 A * 7/1918 Thompson ..... B42F 19/00 116/237
1,366,436 A * 1/1921 Vincent ..... A41D 13/087 294/25
1,844,507 A 2/1932 Gifford
1,863,960 A 6/1932 Aronson
2,203,308 A * 6/1940 Rives ..... B42D 9/04 294/25
3,283,888 A 11/1966 Scott
3,985,383 A 10/1976 Yonkers
4,901,665 A 2/1990 Carlin
5,325,811 A 7/1994 Miroyan
5,437,240 A 8/1995 Miroyan
D362,016 S 9/1995 Faulkingham
5,515,809 A 5/1996 Weinberg
5,609,375 A * 3/1997 Cohen ..... B42D 9/04 294/25
5,772,268 A * 6/1998 Chabrier ..... B42D 9/04 294/187
6,994,052 B1 * 2/2006 McMullen ..... B42D 9/008 116/234

(Continued)

FOREIGN PATENT DOCUMENTS

GB 2443403 A * 5/2008 ..... B42D 9/001
JP 08052960 A * 2/1996 ..... B42D 9/04

(Continued)

*Primary Examiner* — R. A. Smith
(74) *Attorney, Agent, or Firm* — Cramer Patent & Design, PLLC; Aaron R. Cramer

(57) ABSTRACT

A system comprising a book mark, reading ring and finger sock configured to be inserted between the pages of a book to mark a page further includes a slidable marker to indicate a particular line a user has last read. The book mark also comprises a tractable portion that is configured to removable adhere to a page of a book. The reading ring and finger sock are worn on a user's finger or thumb and is made of resilient material to assist in turning the pages of a book.

12 Claims, 5 Drawing Sheets

(56) References Cited

U.S. PATENT DOCUMENTS

| | | | | |
|---|---|---|---|---|
| 7,055,861 | B1 * | 6/2006 | Lee | B42D 9/005 116/234 |
| 7,441,512 | B2 | 10/2008 | Swallow et al. | |
| 7,744,137 | B2 * | 6/2010 | Mazyck | B42D 9/04 294/25 |
| 2007/0118947 | A1 * | 5/2007 | Lorenzo | A41D 13/087 2/21 |

FOREIGN PATENT DOCUMENTS

| | | | | |
|---|---|---|---|---|
| JP | 2001287481 | A * | 10/2001 | B42D 9/04 |
| KR | 2012123787 | A * | 11/2012 | B42D 9/04 |
| KR | 20150029953 | A * | 3/2015 | B42D 9/00 |
| WO | WO 2005122808 | A2 * | 12/2005 | A41D 13/087 |

* cited by examiner

BOOKMARK WITH LINE INDICATOR AND PAGE TURNER

RELATED APPLICATIONS

The present invention was first described in and claims the benefit of U.S. Provisional Application No. 62/160,073, filed May 12, 2015, the entire disclosures of which are incorporated herein by reference.

FIELD OF THE INVENTION

The present invention relates generally to the field of book accessories and more specifically relates to a bookmark and reading ring system as a page turning assist tool.

BACKGROUND OF THE INVENTION

Many people have access to and read books in modern society. A book is a set of written, printed, illustrated, or blank sheets, made of ink, paper, parchment, or other materials, usually fastened together to hinge at one (1) side. A single sheet within a book is called a leaf, and each side of a leaf is called a page. A set of text-filled or illustrated pages produced in electronic format is known as an electronic book, or e-book. Pages of books may be difficult to turn as an individual reads the book; this is not desirable.

Bookmarks may be used to mark a position in the book as the reader pauses. A bookmark typically is a thin marker, commonly made of card, leather, or fabric, used to keep the reader's place in a book and to enable the reader to return to it with ease. Other frequently used materials for bookmarks are paper, metals like silver and brass, silk, wood, and cord. Many bookmarks can be clipped on a page with the aid of a page-flap. Bookmarks are generally singular in purpose. A suitable solution is desired.

Various attempts have been made to solve problems found in book accessory art. Among these are found in: U.S. Pat. No. 5,632,225; U.S. Pat. App. Pub. No. 2008/0018123; and U.S. Pat. No. 4,186,683. These prior art references are representative of book accessories.

None of the above inventions and patents, taken either singly or in combination, is seen to describe the invention as claimed. Thus, a need exists for a reliable bookmark and reading ring system, and to avoid the above-mentioned problems.

SUMMARY OF THE INVENTION

The present invention advantageously fills the aforementioned deficiencies by providing a system for assisting in marking and turning pages, comprising a bookmark and a ring. The book mark comprises a tractable portion located on a front side and adjacent a top side and also has a line marker which is movable relative to a longitudinal line marker channel while being subjacent to the tractable portion. The ring may be of unitary or aggregate construction and is capable of being worn about a digit of a user. The tractable portion and ring are capable of temporarily contacting an individual element from a stack of such elements for the purpose of subsequent removal and/or repositioning.

The line marker may comprise a channel guide, a front tab secured superjacent to the channel guide, a first rear tab secured subjacent to the channel guide and a second rear tab secured subjacent to the channel guide and adjacent the first rear tab. The front tab is moveably secured over a front side portion of the channel while the channel guide is moveably secured within the channel and while the first rear tab and the second rear tab are each secured over a rear side portion of the channel.

The ring may comprise a first arch, a second arch secured under the first arch, a top ring secured to each bottom end of the first arch and the second arch and a bottom ring secured to the top ring by a first vertical support, a second vertical support and a half helix support. The first arch, the second arch, the top ring, the bottom ring, the first vertical support, the second vertical support and the half helix support define a having an inner cavity capable of being friction fit about a digit. The bookmark may comprise plastic, wood and metal and the ring comprises rubber. The tractable portion may comprise a material capable of generating static cling or a reusable and temporary adhesive.

The system may be utilized for marking and turning pages in the following manner: firstly, obtaining a book mark having a tractable portion located on a front side and adjacent a top side thereof; secondly, obtaining a ring; thirdly, securing the ring about a digit; fourthly, obtaining a book; fifthly, utilizing the tractable portion to remove or reposition pages of the book; sixthly, utilizing the finger sock to remove or reposition pages of the book; seventhly, aligning the line marker to a desired position within the book; seventhly, closing the book about the bookmark; and lastly, removing the ring. As an additional step, the ring may also be utilized to remove or reposition pages of the book.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
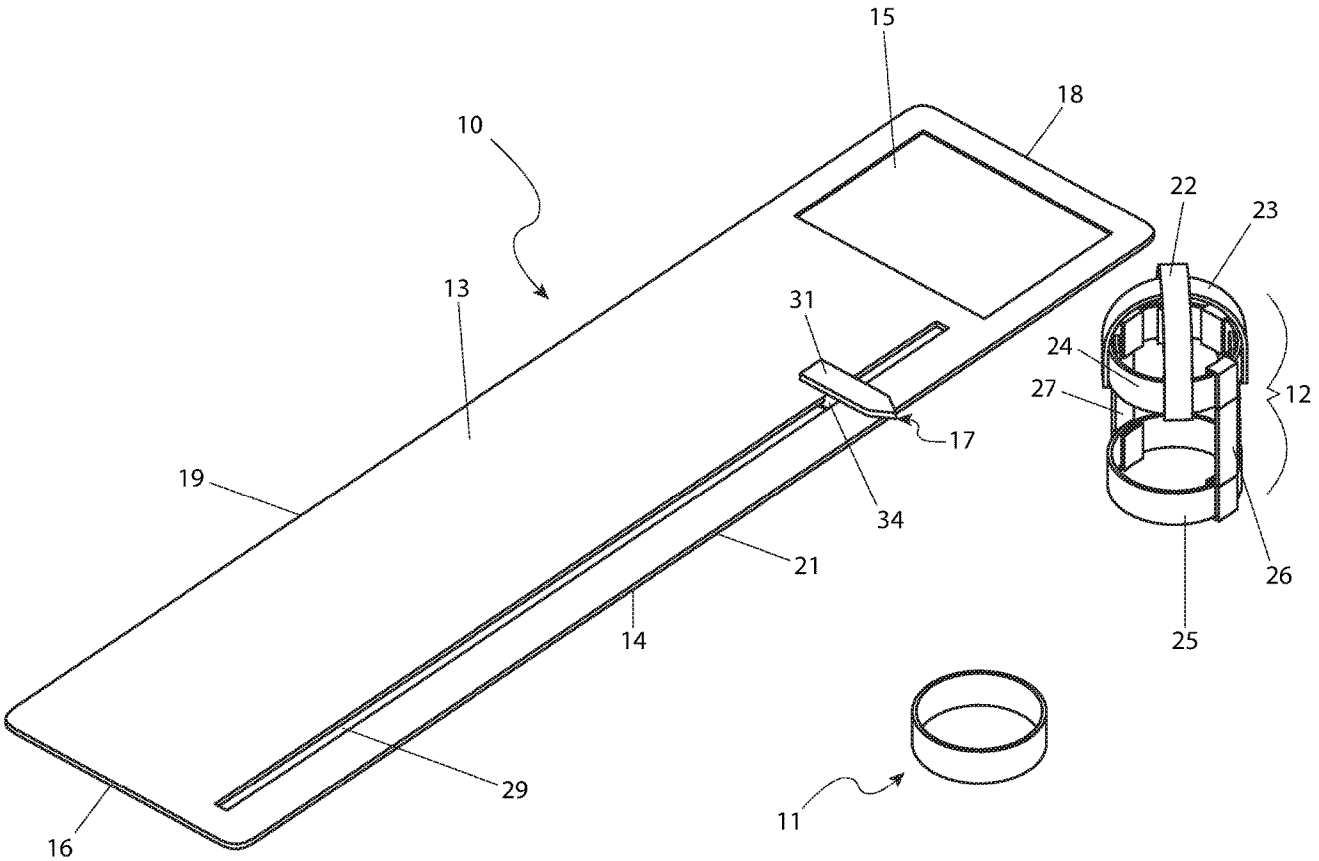
FIG. 1 is a top side perspective view of a bookmark 10, reading ring 11 and finger sock 12 according to a preferred embodiment of the present invention.

10 bookmark
11 reading ring

12 finger sock
13 bookmark front side
14 bookmark rear side
15 tractable portion
16 bookmark bottom side
17 line marker
18 bookmark top side
19 bookmark left side
20 finger
21 bookmark right side
22 first arch
23 second arch
24 top ring
25 bottom ring
26 first vertical support
27 second vertical support
28 half helix support
29 line marker channel
30 book
31 front tab
32 first rear tab
33 second rear tab
34 channel guide

DETAILED DESCRIPTION OF THE PREFERRED EMBODIMENT

Figure 9:
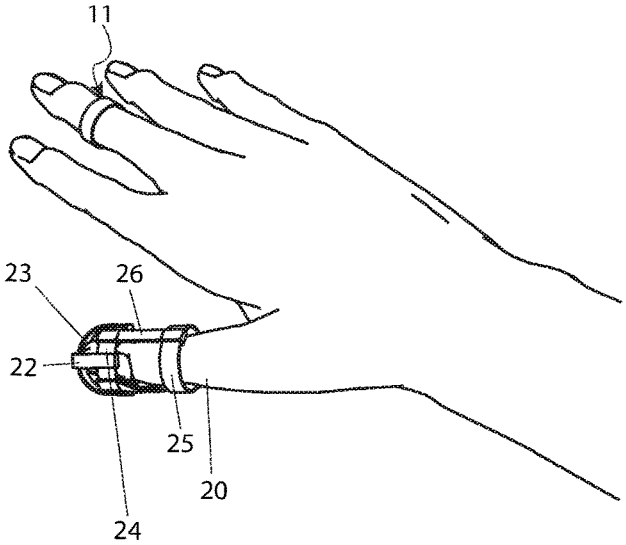

The best mode for carrying out the invention is presented in terms of its preferred embodiment, herein depicted within FIGS. 1 and 9. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

Figure 2:
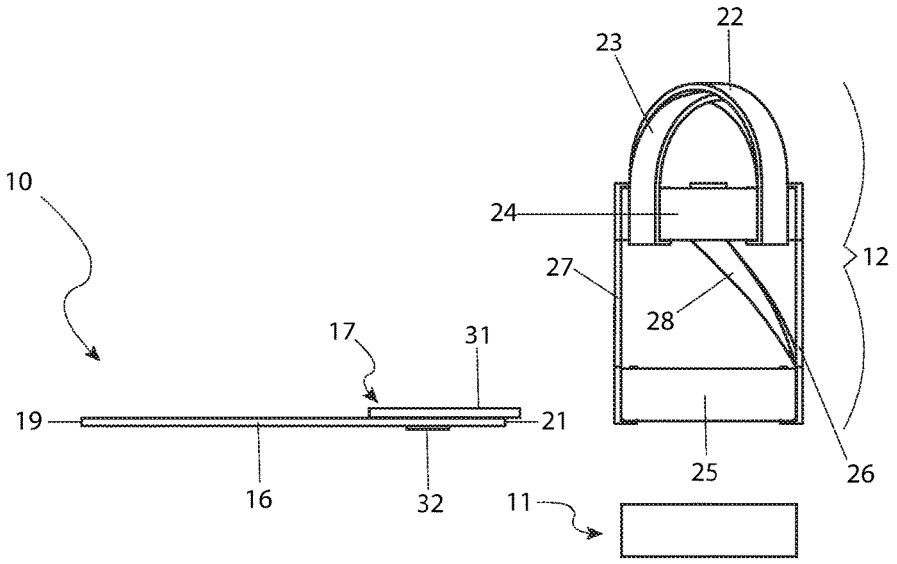
FIG. 2 is a front side elevation view of a bookmark 10, reading ring 11 and finger sock 12 according to a preferred embodiment of the present invention.
Figure 3:
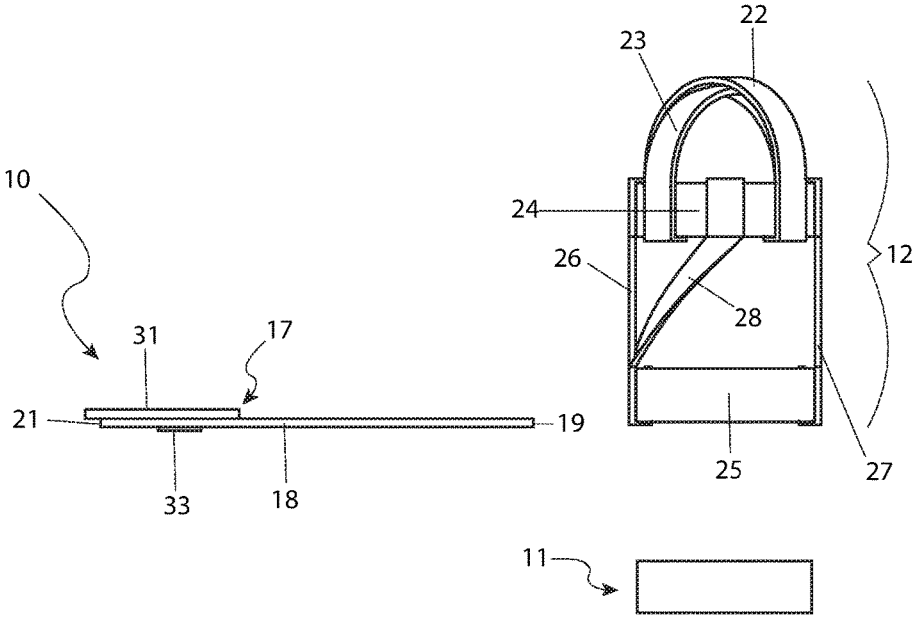
FIG. 3 is a back side elevation view of a bookmark 10, reading ring 11 and finger sock 12 according to a preferred embodiment of the present invention.
Figure 4:
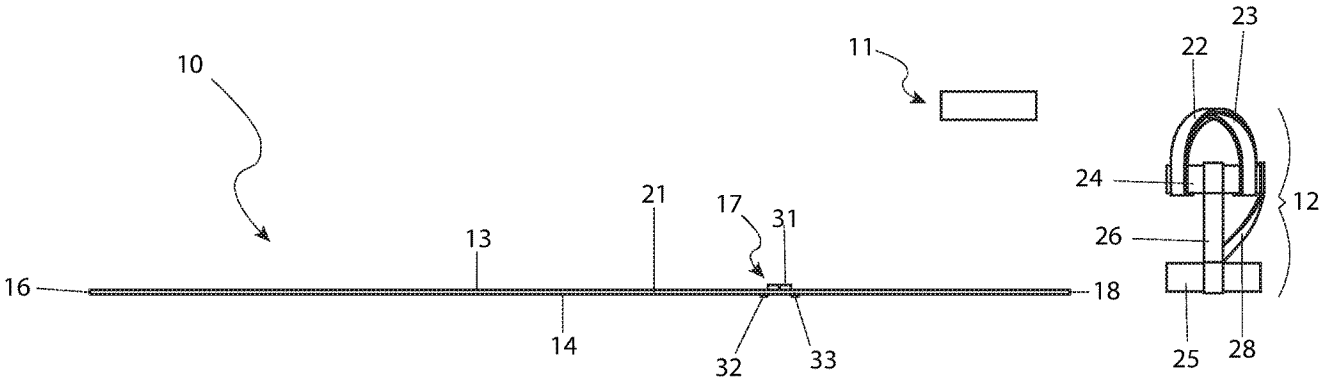
FIG. 4 is a right side elevation view of a bookmark 10, reading ring 11 and finger sock 12 according to a preferred embodiment of the present invention.
Figure 5:
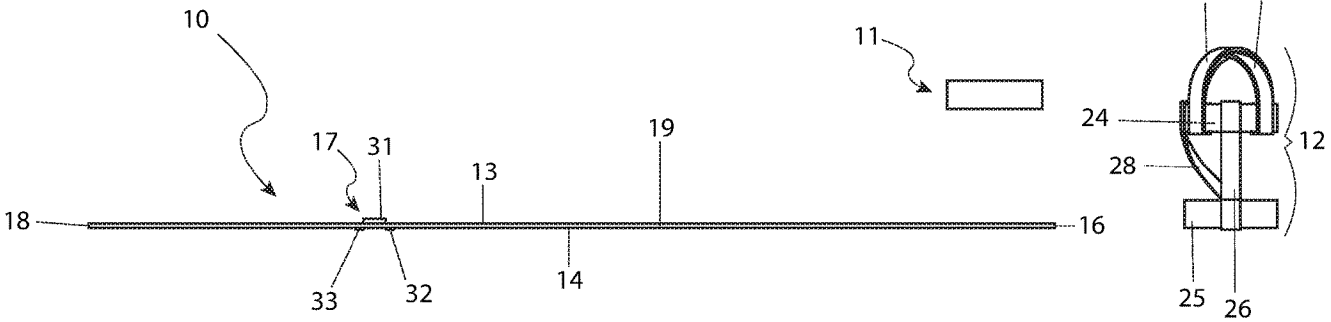
FIG. 5 is a left side elevation view of a bookmark 10, reading ring 11 and finger sock 12 according to a preferred embodiment of the present invention.
Figure 6:
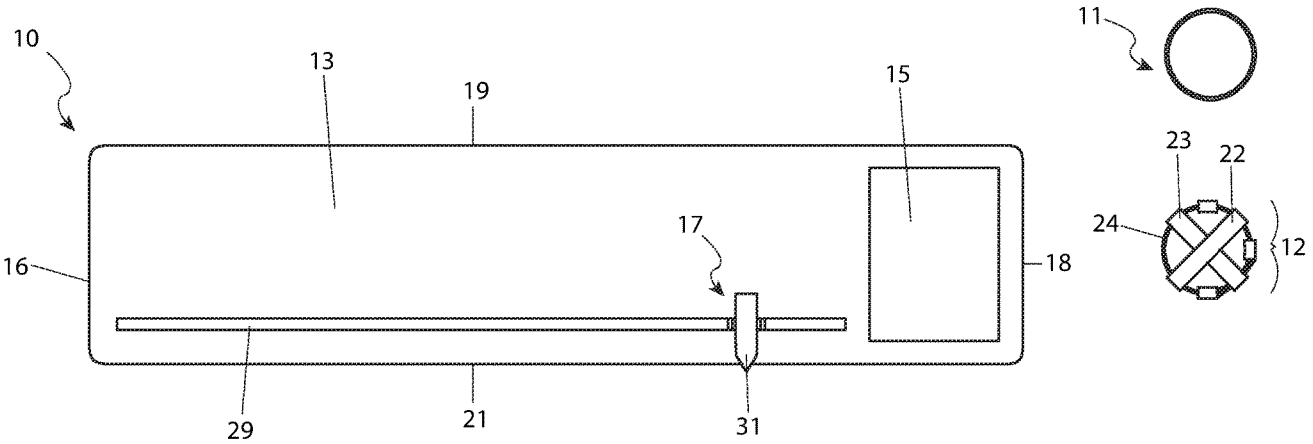
FIG. 6 is a top side plan view of a bookmark 10, reading ring 11 and finger sock 12 according to a preferred embodiment of the present invention.
Figure 7:
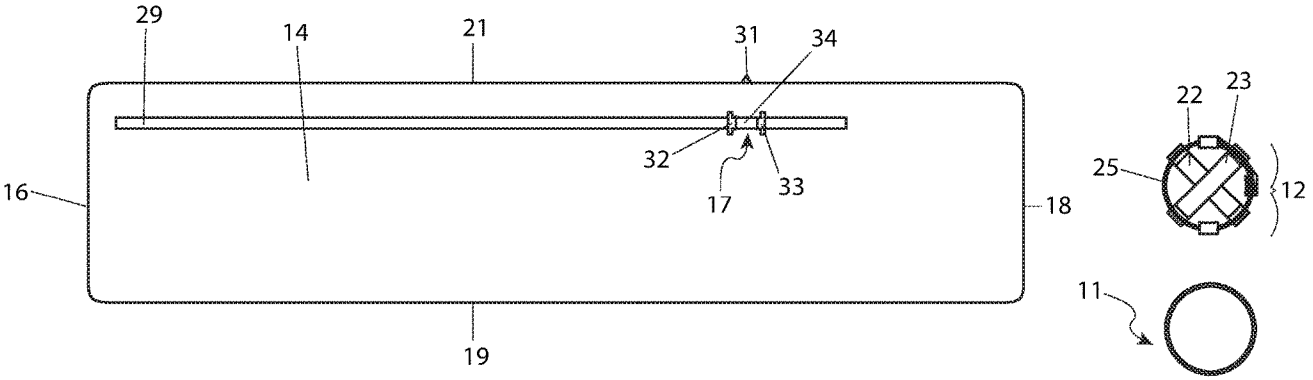
FIG. 7 is a bottom side plan view of a bookmark 10, reading ring 11 and finger sock 12 according to a preferred embodiment of the present invention.
Figure 8:
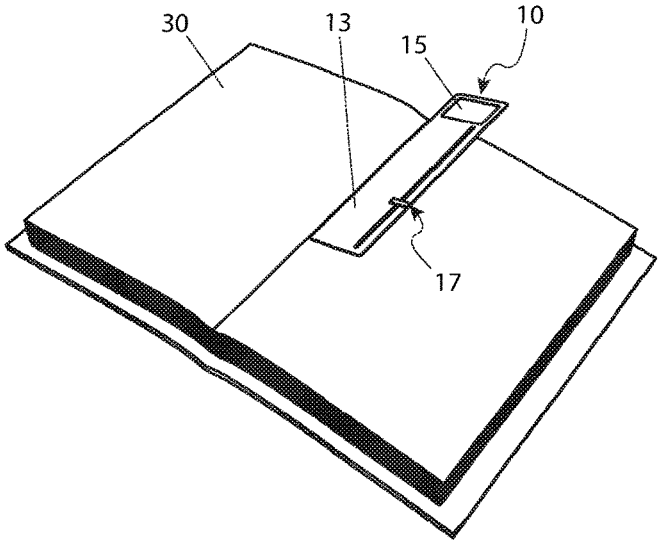
FIG. 8 is an environmental view of a bookmark 10 according to a preferred embodiment of the present invention; and, FIG. 9 is an environmental view of a reading ring 11 and finger sock 12 according to a preferred embodiment of the present invention.

The present invention is directed to a book accessory. Referring now to the drawings, FIG. 1 is a top side perspective view of a bookmark 10, reading ring 11 and finger sock 12 according to a preferred embodiment of the present invention, FIG. 2 is a front side elevation view of a bookmark 10, reading ring 11 and finger sock 12 according to a preferred embodiment of the present invention, FIG. 3 is a back side elevation view of a bookmark 10, reading ring 11 and finger sock 12 according to a preferred embodiment of the present invention, FIG. 4 is a right side elevation view of a bookmark 10, reading ring 11 and finger sock 12 according to a preferred embodiment of the present invention, FIG. 5 is a left side elevation view of a bookmark 10, reading ring 11 and finger sock 12 according to a preferred embodiment of the present invention, FIG. 6 is a top side plan view of a bookmark 10, reading ring 11 and finger sock 12 according to a preferred embodiment of the present invention, FIG. 7 is a bottom side plan view of a bookmark 10, reading ring 11 and finger sock 12 according to a preferred embodiment of the present invention, FIG. 8 is an environmental view of a bookmark 10 according to a preferred embodiment of the present invention and FIG. 9 is an environmental view of a reading ring 11 and finger sock 12 according to a preferred embodiment of the present invention.

Depicted within FIGS. 1-8 is the preferred embodiment of a novel bookmark 10 which comprises a tractable portion 15 at the top that will turn a page by removable adhering to the same. The tractable portion 15 may comprise of any static cling or reusable temporary adhesive. The line marker 17 marks the last line read and comprises a front tab 31, a first rear tab 32, a second rear tab 33, and a channel guide 34. The line marker is slidable within the line marker channel 29.

The line marker is secured within the line marker channel 29 with the front tab 31 secured over the bookmark front side 13 of the line marker channel 29 and the first rear tab 32 and the second rear tab 33 secured over the bookmark rear side 14 of the line marker channel 29. A channel guide 34 slidably resides within the line marker channel 29 and secures the front tab 31 superjacent to the first rear tab 32 and the second rear tab 33. The first rear tab 32 is secured to the channel guide 34 and is adjacent to the second rear tab 33 which is likewise secured to the channel guide 34.

The preferred embodiment of the reading ring 11 is also depicted within FIGS. 1-8 and provides a gripping means by which to turn pages of a book with relative ease or to count money, among other tasks. The finger sock 12 preferably includes a first arch 22, a second arch 23 perpendicularly secured under the first arch 22, a top ring 24 secured to the bottom ends of the first arch 22 and the second arch 23, a bottom ring 25 secured beneath the top ring 24 by a first vertical support 26, a second vertical support 27, and a half helix support 28. The first arch 22, the second arch 23, the top ring 24, the bottom ring 25, the first vertical support 26, the second vertical support 27 and the half helix support 28 define an inner cavity.

The reading ring 11 and finger sock 12 may comprise pliable plastic and be of unitary and molded construction or with respect to the finger sock 12, constitute a plurality of the aforementioned sections 22, 23, 24, 25, 26, 27 and/or 28, being permanently bonded to each other in the positions described above. Certain embodiments of the bookmark 10 may comprise wood, plastic, metal or other suitable materials. The bookmark 10 may be produced in various sizes for various sized books. The reading ring 11 and finger sock 12 may also be produced in various sizes for different finger or thumb 20 sizes. This invention will provide a more efficient and precise means for page turning of books, stacks of paper or money for better paper management and control. Thus, the system reduces the frustration associated with these tasks.

FIG. 9 shows a perspective view illustrating use of the reading ring 11 and finger sock 12 for sorting papers according to an embodiment of the present invention. The exact specifications, materials used, and method of use of the bookmark 10, reading ring 11 and finger sock 12 may vary upon manufacturing.

As previously discussed, the reading ring 11 and finger sock 12 may be sufficiently tight to provide comfort and friction fit to the finger or thumb 20. It is not desirable for the reading ring 11 or finger sock 12 to be too tight or loose for proper use. For example, the finger sock 12 and reading ring 11 combination may be used when opening shopping bags to place groceries items inside. The finger sock 12 may be used on different fingers or thumbs 20 or in a combination. Finger socks may cover the entire finger or thumb 20 or portion thereof.

The preferred method of utilizing the bookmark 10, reading ring 11 and finger sock 12 comprises a user firstly obtaining a bookmark 10, reading ring 11 and finger sock 12 having the appropriately sized finger ring 11 and finger sock 12 for the user's finger or thumb 20. Secondly, the user secures the finger ring and/or finger sock 12 about a desired finger or thumb 20. Thirdly, the user begins to read a book 30 and may turn pages of the book 30 as desired using either the tractable portion of the bookmark 10, the reading ring 11 or finger sock 12. Fourthly, the user, upon cessation of reading, slidably aligns the line marker 17 with the last sentence read in the book 30. Lastly, the user closes the book 30 while leaving the bookmark 10 within the book 30 and removes the reading ring 11 and/or finger sock 12.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A system for assisting in marking and turning an individual element from a stack of elements, comprising:

a bookmark, comprising:

a tractable portion located on a first side and adjacent a top side thereof; and, a line marker movable relative to a longitudinal line marker channel and subjacent to said tractable portion;

a ring capable of being worn about a digit of a user; and, a finger sock capable of being worn about a digit of a user;

wherein said tractable portion is capable of temporarily contacting said individual element from said stack of elements for subsequent removal or repositioning;

wherein said ring is capable of contacting said individual element from said stack of elements for subsequent removal or repositioning; and, wherein said finger sock is also capable of contacting said individual element from said stack of elements for subsequent removal or repositioning.

2. The system of claim 1, wherein said line marker further comprises:

a channel guide;

a front tab secured superjacent to said channel guide;

a first rear tab secured subjacent to said channel guide; and, a second rear tab secured subjacent to said channel guide and adjacent said first rear tab;

wherein said front tab is moveably secured over a front side portion of said channel, said channel guide is moveably secured within said channel, and said first rear tab and said second rear tab are each secured over a rear side portion of said channel.

3. The system of claim 1, wherein said finger sock comprises:

a first arch;

a second arch secured under said first arch;

a top ring secured to each bottom end of said first arch and said second arch; and, a bottom ring secured to said top ring by a first vertical support, a second vertical support, and a half helix support;

wherein said first arch, said second arch, said top ring, said bottom ring, said first vertical support, said second vertical support, and said half helix support define an inner cavity capable of being friction fit about said digit.

4. The system of claim 3, wherein said ring comprises rubber.

5. The system of claim 1, wherein said bookmark comprises plastic.

6. The system of claim 1, wherein said bookmark comprises wood.

7. The system of claim 1, wherein said bookmark comprises metal.

8. The system of claim 1, wherein said tractable portion comprises a material capable of generating static cling.

9. The system of claim 1, wherein said tractable portion comprises a reusable temporary adhesive.

10. A method of utilizing a system for assisting in marking and turning pages of a book comprising the following steps:

obtaining a bookmark having a tractable portion located on a first side and adjacent a top side thereof, and a line marker movable relative to a channel and subjacent to said tractable portion;

obtaining a ring;

securing said ring about a digit;

obtaining a finger sock;

securing said finger sock about a digit;

obtaining said book;

utilizing said tractable portion to remove or reposition pages of said book;

utilizing said finger sock to remove or reposition pages of said book; and, aligning said line marker to a desired position within said book.

11. The method of claim 10, further comprising the step of utilizing said ring to remove or reposition desired pages of said book.

12. A system for assisting in marking and turning an individual element from a stack of elements, comprising:

a finger sock capable of being worn about a digit of a user, comprising:

a first arch;

a second arch secured under said first arch;

a top ring secured to each bottom end of said first arch and said second arch; and, a bottom ring secured to said top ring by a first vertical support, a second vertical support, and a half helix support;

wherein said first arch, said second arch, said top ring, said bottom ring, said first vertical support, said second vertical support, and said half helix support define an inner cavity capable of being friction fit about said digit; and, wherein said finger sock is also capable of contacting said individual element from said stack of elements for subsequent removal or repositioning.

* * * * *